United States Patent [19]

Selby

[11] Patent Number: 4,598,181

[45] Date of Patent: Jul. 1, 1986

[54] LAMINATE SWITCH ASSEMBLY HAVING IMPROVED TACTILE FEEL AND IMPROVED RELIABILITY OF OPERATION

[75] Inventor: Steve F. Selby, Huntsville, Ala.

[73] Assignee: GTE Communication Systems Corp., Northlake, Ill.

[21] Appl. No.: 670,083

[22] Filed: Nov. 13, 1984

[51] Int. Cl.[4] ..... H01H 13/00

[52] U.S. Cl. ..... 200/5 A; 200/159 B; 200/292; 200/340

[58] Field of Search ..... 361/400, 401; 200/5 A, 200/85 R, 86 R, 159 R, 159 B, 330, 333, 340, 292, 306

[56] References Cited

U.S. PATENT DOCUMENTS 3,133,170 5/1964 Nanninga ..... 200/159 B
3,829,632 8/1974 Klehm, Jr. ..... 200/5 A
3,995,126 11/1976 Larson ..... 200/159 B
4,086,451 4/1978 Boulanger ..... 200/5 A
4,127,752 11/1978 Lowthorp ..... 200/340
4,334,134 6/1982 Janda ..... 200/159 B

*Primary Examiner*—G. P. Tolin
*Attorney, Agent, or Firm*—Robert J. Black; Gregory G. Hendricks

[57] ABSTRACT

A laminate switch assembly comprising dual dome switchplates providing improved tactile sensation good balance characteristics and able to maintain a low dynamic resistance throughout its life expectancy. Both tensioned domes are aligned with electrical contact areas part of which is formed on the underside of one dome and the other on a printed circuit board or backplate, which in response to depression are placed in contact with each other to provide a switch closure to a connected or associated electrical device.

1 Claim, 1 Drawing Figure

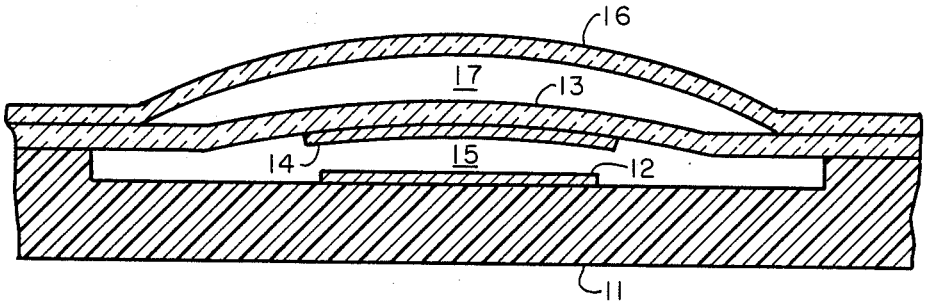
16
17
13
14
15
12
11

LAMINATE SWITCH ASSEMBLY HAVING IMPROVED TACTILE FEEL AND IMPROVED RELIABILITY OF OPERATION

BACKGROUND OF THE INVENTION

1. Field of the Invention

This invention relates generally to laminate switch assemblies wherein tentioned diaphrams provide a tactile indication of switch activation; and more particularly to an improved switch activating diaphragm structure which provides more reliable operation and an improved tactile feel.

2. Background Art

A large variety of printed circuit contact switches are available for use as telephone calling devices or information input keyboards. Such devices are used for an ever expanding number of products including telephones, calculators, and numerous other devices. Of the available switch varieties many do not provide tactile feedback and hence may be unacceptable for some users.

An inexpensive way to form keyboards having tactile feedback is to deposit electrical contact patterns onto a printed circuit board and to provide a tensioned diaphragm or dome over each of the contact patterns. Electrically conductive pads which match the contact patterns on the circuit board are then provided so that when a dome is depressd by the operator's finger, an associated pad contacts one of the deposited contact patterns thus completing an electrical circuit through the contact pattern. Upon removal of the operating force the tensioned dome springs back to its initial unoperated position to open the circuit through the contact pattern. The electrically conductive pads can be provided on the interior surface of the dome or may be provided on a separate contact sheet formed of insulating material.

Such switch assemblies form reliable electrical connections and provide a measure of tactile feedback to the operator, to reassure the operator that the switch contact has been closed. However, the degree of tactile feedback may vary depending upon the form of switch construction employed.

SUMMARY OF THE INVENTION

In accordance with the present invention, a laminate switch assembly is constructed to include a tensioned dome in contact with a flexible circuit element positioned over shorting contacts on a rigid back plate. Superimposed above the entire structure is a second tensioned dome positioned directly above the first with an air space or bubble located between the two tensioned domes. The domes informed out of commercially available thermoplastic material, a number of domes based on the requirements of the switch mechanism are formed into the thermoplastic at the same time. Both the domes employed for each switch are of approximately the same size and cross-sectional thickness with the first dome not being arched as extremely as the upper or the top dome.

Key designations can be formed directly into the tensioned domes if desired or in the alternative separate push button structures can be placed above and in contact with the upper dome of each switch assembly.

Laminated switch assemblies incorporating improved construction in accordance with the present invention comprise separate electrical switch contact pads spaced from the printed circuit board, formed or deposited on the surface of a rigid back plate, as a so called shorting pad. The dual dome structure of the present switch overcomes the undesirable conditions of poor tactile feel or of receiving a tactile sensation from the switch with no actual contact closure.

The primary or top layers function provides tactile feel while the secondary layer contains the switch circuitry. The circuitry is made (or shorted) via the conductive medium on the back plate of the key pad assembly. By embossing or constructing the secondary layer in dome form it is possible to reduce the dampening affect as well as to eliminate the users perception to tactile feel without an actual contact closure. Accordingly it is the object of the present invention to provide a new and useful switch mechanism which overcomes a number of the shortcomings found in similar devices in the prior art.

BRIEF DESCRIPTION OF THE DRAWINGS

The single FIGURE of the attached drawing is a sectional view of a laminate switch assembly in accordance with the present invention.

DESCRIPTION OF THE PREFERRED EMBODIMENT

With reference now to the accompanying drawing a five layer laminate switch assembly constructed in accordance with the present invention is shown in cross section. The first layer 11 comprises a circuit board or backplate on which conductive circuit pads or shorting pads 12 are deposited or affixed by some other means. The shorting pad or circuit pads 12 are located in a recessed area 15 included in the backplate or circuit board 11. Positioned on the circuit board 11 is sheet 13 of electrically insulating material which includes electrically conductive circuit pads or circuit conductors 14 located on the underside thereof. That portion of insulating layer 13 upon which conductors 14 are affixed or deposited, is embossed in a slightly dome-shaped configuration with the top of dome extending away from the backplate portion of the present switch.

As may be seen by reference to the drawing a slightly dome-shaped space is thus present between conductors 12 and 14 in the normal or nonoperated position of the switch in accordance with the present invention.

Located over the fourth layer 13 is a fifth layer 16 also of electrically insulating material configured in a dome fashion of substantially greater height than that included in the fourth layer 13 and positioned over dome-shaped portion of the fourth layer 13, as well as the two contact 12 and 14. A space 17 exists between domeshaped portions of the fourth layer 13 and the fifth layer 16, to particularly facilitate operation in accordance with the present invention. The fifth layer or top layer 16 maybe fashioned of commercially available thermoplastic material.

In the switch accordance with the present invention the top layer 16 functions to provide tactile feel while the secondary dome 13 contains keypad circuitry 14 located on the under portion thereof. The circuit is made or shorted via the conductive medium 12 located on the backplate 14 of the keypad assembly. By including a dome-shaped structure in the secondary layer 13 the dampening effect is reduced as well as eliminating the users perception of tactile feel prior to the time that actual contact closure occurs.

The action of the switch of the present invention when actuated by depressing the upper dome sixteen will cause the upper dome to snap through the secondary dome 13 which only at that time mates with the shorting contacts providing input from the switch closure to the electrical device connected to the switch of the present invention.

While but a single embodiment of the present invention has been shown it will be obvious to those skilled in the art that numerous modifications may be made to the present invention without departing from the spirit of the invention which shall be limited only by the scope of the claims appended hereto.

What is claimed is:

1. A laminate switch assembly comprising: a printed circuit board including a recessed portion and having at least one electrical contact area formed thereon; a first switch plate having a tensioned dome aligned with said electrical contact area on said circuit board; a second switch plate having a tensioned tactile dome positioned over said tensioned dome of said first dome switch plate; said first and said second switch plates formed of a thermal plastic material; said domes on said first and second switch plates both arched in an upward direction; said tensioned tactile dome arched substantially higher than said tensioned dome; said tactile dome contacting said tensioned dome when depressed; and contact means comprising an electrically conductive coating on the interior surface of said tensioned dome, interposed between said circuit board and said first switch plate for providing an electrical connection to said contact area responsive to depression of said tactile dome.

* * * * *